US012078185B2

(12) United States Patent
McCullough et al.

(10) Patent No.: US 12,078,185 B2
(45) Date of Patent: Sep. 3, 2024

(54) BEARING-LESS TURBINE

(71) Applicant: Fluid Handling LLC, Morton Grove, IL (US)

(72) Inventors: Andrew Clay McCullough, Lubbock, TX (US); Larry Allen Howard, Lubbock, TX (US); Manish Vinubhai Patel, Gujarat (IN)

(73) Assignee: FLUID HANDLING LLC, Morton Grove, IL (US)

( * ) Notice: Subject to any disclaimer, the term of this patent is extended or adjusted under 35 U.S.C. 154(b) by 53 days.

(21) Appl. No.: 16/885,501

(22) Filed: May 28, 2020

(65) Prior Publication Data

US 2020/0378396 A1 Dec. 3, 2020

Related U.S. Application Data

(60) Provisional application No. 62/854,038, filed on May 29, 2019.

(51) Int. Cl.
*F04D 29/046* (2006.01)
*F04D 19/02* (2006.01)
(Continued)

(52) U.S. Cl.
CPC ..... *F04D 29/046* (2013.01); *F04D 19/022* (2013.01); *F04D 29/026* (2013.01); *F04D 29/043* (2013.01); *F04D 29/548* (2013.01)

(58) Field of Classification Search
CPC ..... F04D 29/046; F04D 19/02; F04D 17/122; F04D 13/00; F04D 1/06; F04D 1/14
See application file for complete search history.

(56) References Cited

U.S. PATENT DOCUMENTS 1,976,200 A 10/1934 Swanson
3,973,871 A 8/1976 Hance
(Continued)

FOREIGN PATENT DOCUMENTS

CN 87104408 A 12/1987
CN 1056736 A 12/1991
(Continued)

OTHER PUBLICATIONS

"Pump Bearing Design Manual" (Vesconite and Vesconite Hilube) Nov. 2016 [retrieved on Dec. 8, 2021]. Retrieved from the internet: <https://hlgroup.fi/wp-content/uploads/2016/11/Vesconite-Hilube-Pump_Bearing_Design_Manual.pdf> (Year: 2016).*
(Continued)

*Primary Examiner* — David E Sosnowski
*Assistant Examiner* — Jackson N Gillenwaters
(74) *Attorney, Agent, or Firm* — Ware, Fressola, Maguire & Barber LLP

(57) ABSTRACT

A vertical pump features stationary bowl assembly, a rotating power transmission shaft, impellers and bottom wear-ring bearings. The stationary bowl assembly includes bowls, each bowl having a respective bowl bottom inside surface. The rotating power transmission shaft is configured to extend through the stationary bowl assembly. The impellers are arranged on the rotating power transmission shaft to rotate and draw material through the stationary bowl assembly, each impeller having a respective impeller bottom outside surface. Each bottom wear-ring bearing is arranged between the respective impeller bottom outside surface of each impeller and the respective bowl bottom inside surface of each bowl, made from a non-galling bearing material, and configured to maintain the alignment of the rotating power transmission shaft in relation to the stationary bowl assembly.

10 Claims, 3 Drawing Sheets

(51) Int. Cl.

| | |
|---|---|
| ***F04D 29/02*** | (2006.01) |
| ***F04D 29/043*** | (2006.01) |
| ***F04D 29/54*** | (2006.01) |

(56) References Cited

U.S. PATENT DOCUMENTS

| | | | | |
|---|---|---|---|---|
| 4,462,751 | A | 7/1984 | Smith et al. | |
| 4,923,367 | A | 5/1990 | Zimmer | |
| 4,925,408 | A | 5/1990 | Webb et al. | |
| 5,425,618 | A | 6/1995 | Janigro et al. | |
| 5,487,644 | A | 1/1996 | Shigaki et al. | |
| 5,624,226 | A | 4/1997 | Yamada et al. | |
| 5,993,153 | A | 11/1999 | Schiavello et al. | |
| 6,089,823 | A * | 7/2000 | Cronin | F04D 29/2288 241/46.06 |
| 6,343,913 | B1 | 2/2002 | Ohsaki | |
| 8,398,361 | B2 | 3/2013 | Sagoo et al. | |
| 8,894,350 | B2 | 11/2014 | Brunnner et al. | |
| 9,200,642 | B2 | 12/2015 | Nowitzki et al. | |
| 9,677,560 | B1 | 6/2017 | Davis et al. | |
| 9,677,562 | B2 | 6/2017 | McManus et al. | |
| 10,161,411 | B1 | 12/2018 | Gottschalk et al. | |
| 2012/0020777 | A1 | 1/2012 | Eslinger | |
| 2012/0213632 | A1 * | 8/2012 | Parry | F04D 13/08 415/208.1 |
| 2015/0098794 | A1 * | 4/2015 | Baski | E21B 43/126 415/1 |
| 2017/0102009 | A1 | 4/2017 | Johnson et al. | |
| 2018/0291907 | A1 | 10/2018 | Ye et al. | |
| 2019/0219068 | A1 * | 7/2019 | Behnke | F04D 1/06 |
| 2021/0048029 | A1 * | 2/2021 | Ye | F04D 29/046 |

FOREIGN PATENT DOCUMENTS

| | | | |
|---|---|---|---|
| CN | 202417965 | U | 9/2012 |
| CN | 104033418 | A | 9/2014 |
| CN | 105864053 | A | 8/2016 |
| CN | 205423173 | U | 8/2016 |
| CN | 107355389 | A | 11/2017 |
| CN | 207212735 | U | 4/2018 |
| CN | 207813960 | U | 9/2018 |
| CN | 208169147 | U | 11/2018 |
| CN | 208749588 | U | 4/2019 |
| EP | 0 718 501 | A1 | 6/1996 |
| EP | 0664398 | B1 | 7/1998 |
| FR | 2921445 | B1 | 10/2016 |
| GB | 1189198 | | 4/1970 |
| GB | 2414278 | A | 11/2005 |
| WO | 2018/209011 | A1 | 11/2018 |
| WO | 2019/063552 | A1 | 4/2019 |

OTHER PUBLICATIONS

"Wayback Machine" [Archive for https://www.hydro-watt.com/assets/vesconite-pump-bearing-design-manual.pdf] May 2022. Retrieved from internet: <https://web.archive.org/web/20180508092001/https://www.hydro-watt.com/assets/vesconite-pump-bearing-design-manual.pdf> (Year: 2022).*

"Google" [Google search for "vesconite and vesconite hilube"] May 2022. Retrieved from the internet: <tinyurl.com/5t54zsz7> (Year: 2022).*

"Pump Bearing Design Manual" (Vesconite and Vesconite Hilube); Nov. 2016; retrieved from Internet: https://hlgroup.fi/wp-content/uploads/2016/11/Vesconite-Hilube-Pump_Bearing_Design_Manual.pdf; entire document, especially p. 9.

"1100 Series Multi-Stage Vertical Turbine Pumps," Layne/Veri-Line®, watertechltd.com, May 6, 2017. https://web.archive.org/web/20 170506191731/http://www.watertechltd.com/images/pumps/lv-02-1201.pdf.

"Vertical Turbine Pumps," Goulds Pumps, gouldspumps.com, Apr. 12, 2016. https://web.archive.org/web/20160412213105/https://www.gouldspumps .com/ittgp/medialibrary/goulds/website/Literature/Brochures/Product%20Bulletins/Alphabetical/Goulds_Vertical_Reader.pdf?ext=.pdf.

English language Abstract of FR2921445B1.
English language Abstract of EP0664398B1.
English language Abstract of CN208749588U.
English language Abstract of CN208169147U.
English language Abstract of CN207813960U.
English language Abstract of CN207212735U.
English language Abstract of CN202417965U. 2012.
English language Abstract of CN107355389A. 2017.
English language Abstract of CN105864053A. 2016.
English language Abstract of CN87104408A. 1987.
English language Abstract of CN104033418A. 2014.
English language Abstract of CN1056736A. 1991.
English language Abstract of CN205423173U. 2016.

* cited by examiner

BEARING-LESS TURBINE

CROSS-REFERENCE TO RELATED APPLICATION

This application claims benefit to provisional patent application Ser. No. 62/854,038, filed 29 May 2019, which is hereby incorporated by reference in its entirety.

BACKGROUND OF THE INVENTION

1. Field of the Invention

The present invention relates to a vertical pump; and more particularly to a vertical turbine pump.

2. Brief Description of Related Art

FIG. 1 shows a vertical turbine pump that is known in the art. The pressure generating portion of the vertical turbine pump, frequently called a bowl assembly, makes use of bearings of varying materials (such as bronze), e.g., including a bowl bearing located above each impeller, and a suction bearing located below a bottom impeller in a suction bell or suction bowl of the bowl assembly. In FIG. 1, the bowl bearing located above each impeller is arranged between an inner part of each bowl of the bowl assembly and the power transmission shaft, and the suction bearing located below the bottom impeller is arranged between a suction bearing retainer of the suction bell or suction bowl and the power transmission shaft. These bearings have a primary function to maintain the alignment of the power transmission shaft with the centerline of the static pressure containing elements. An additional function is to raise the resonant frequency of the bowl assembly to ensure lateral vibration of the power transmission shaft is not observed. In FIG. 1, the vertical turbine pump includes a wear ring for each impeller that is located between an impeller bottom outside surface of each impeller and a bowl bottom inside surface of each bowl. Wear rings are primarily employed as a replaceable, ablative wearing surface between two elements that translate relative to each other, e.g., such as in the case of a rotating impeller element and a stationary bowl element. Wear rings also allow for reduced circulation between the high pressure side of a rotating impeller and the low pressure side, thereby improving the pump's mechanical efficiency. This is accomplished by reducing the running clearances between the rotating impeller and the stationary bowl, this reduction in area increases the pressure drop across the high pressure side to the low pressure side of the rotating impeller, and with a reduction in potential, there is a corresponding reduction in the undesirable recirculating flow.

Some of the Shortcomings of the Above Mentioned Devices; The suction bearing and its corresponding suction bearing retainer located in the suction bell/bowl of the pump partially obscures the eye of the bottom impeller and therefore increases the required ambient pressure in the surrounding fluid to prevent the cavitation of the pump. This increase in required suction pressure correspondingly increases the required submergence in open applications, and increases the required suction line pressure in closed-loop applications. Less significantly, the overall efficiency of the pump is reduced due to this increase in pump entrant losses.

The inclusion of the suction bearing retainer in the suction bell mandates a degree of material strength that would not otherwise be required. This increases product weight and cost.

The principal driver of vibration in a pump is due to the imbalance in the rotating impeller. By using a bearing above and below the rotating impeller, the driving imbalance is equidistant between the two bearing supports. This configuration maximizes the deflection in the power transmission shaft, when the most desirable result is to minimize the deflection in the power transmission shaft.

Hydraulic thrust is generated from a difference in fluid pressure on the top side of the rotating impeller relative to the bottom side of the rotating impeller. This hydraulic thrust can cause the power transmission shaft to be oversized to either increase its strength in some applications, or else to reduce its deflection (stretch) in others. Alternatively, hydraulically balanced impellers may be employed to reduce the effects of the pressure differential, but this introduces an undesirable flow re-circulation that reduces the pump's hydraulic efficiency.

Special care must be taken when using wear rings comprised of materials that will gall. While desirable for corrosion resistance reasons, these materials can cause premature failure of the pump if clearances are not increased, this in turn, increases undesirable re-circulation and a corresponding loss of pump efficiency.

SUMMARY OF THE PRESENT INVENTION

Vertical Pump having Top or Bottom Wear-ring Bearing By way of example, and according to some embodiments, the present invention may include, or take the form of, a vertical pump, featuring a stationary bowl assembly, a rotating power transmission shaft, impellers and top or bottom wear-ring bearings.

The stationary bowl assembly may include bowls, each bowl having a respective bowl top or bottom inside surface.

The rotating power transmission shaft may be configured to extend through the stationary bowl assembly.

The impellers may be arranged on the rotating power transmission shaft to rotate and draw material through the stationary bowl assembly, each impeller having a respective impeller top or bottom outside surface.

Each top or bottom wear-ring bearing may be arranged between the respective impeller top or bottom outside surface of each impeller and the respective bowl top or bottom inside surface of each bowl, may be made from a non-galling bearing material, and configured to maintain the alignment of the rotating power transmission shaft in relation to the stationary bowl assembly.

By way of further example, the pump may also include one or more of the following features:

The top or bottom wear-ring bearings may include bottom wear-ring bearings; each bowl may include a respective bowl bottom inside surface; each impeller may include a respective impeller bottom outside surface; each bottom wear-ring bearing may be arranged between the respective impeller bottom outside surface of each impeller and the respective bowl bottom inside surface of each bowl; and the respective impeller bottom outside surface of each impeller may be configured to rotate directly against a respective bottom wear-ring bearing.

The wear-ring bearings may include top wear-ring bearings; each bowl may have a respective bowl top inside surface; each impeller may have a respective impeller top outside surface; each top wear-ring bearing may be arranged between the respective impeller top outside surface of each impeller and the respective bowl top inside surface of each bowl; and the respective impeller top outside surface of each impeller may be configured to rotate directly against a respective top wear-ring bearing.

The wear-ring bearings may include both top and bottom wear-ring bearings; each bowl may include respective bowl top and bottom inside surfaces; each impeller may include respective impeller top and bottom outside surfaces; each top and bottom wear-ring bearing may be arranged between the respective impeller top and bottom outside surfaces of each impeller and the respective bowl top and bottom inside surfaces of each bowl; and the respective impeller top and bottom outside surfaces of each impeller may be configured to rotate directly against the respective top and bottom wear-ring bearings.

The non-galling bearing material may be a non-metallic material, including Vesconsite®.

The top and bottom wear-ring bearings may be configured to expose a top side of at least one of the impellers to a low pressure side of preceding material being pumped through the stationary bowl assembly.

The top wear-ring bearings may also be configured to isolate the top side of at least one of the impellers from pressure generated by the at least one of the impellers.

The top and bottom wear-ring bearings may be configured to provide substantially reduced running clearances between the at least one impeller and the at least one bowl of the stationary bowl assembly.

The vertical turbine pump may include a suction bell configured to guide flow of the material being pumped into an eye of a bottom impeller.

The suction bell may be made of a non-metallic material, including a non cast iron material. The non-metallic material may be plastic.

Vertical Pump Having Bottom Wear-Ring Bearings

By way of further example, and according to some embodiments, the present invention may include, or take the form of, a vertical pump, featuring a stationary bowl assembly, a rotating power transmission shaft, impellers and bottom wear-ring bearings. The stationary bowl assembly includes bowls, each bowl having a respective bowl bottom inside surface. The rotating power transmission shaft may be configured to extend through the stationary bowl assembly. The impellers may be arranged on the rotating power transmission shaft to rotate and draw material through the stationary bowl assembly, each impeller having a respective impeller bottom outside surface. Each bottom wear-ring bearing may be arranged between the respective impeller bottom outside surface of each impeller and the respective bowl bottom inside surface of each bowl, may be made from a non-galling bearing material, and configured to maintain the alignment of the rotating power transmission shaft in relation to the stationary bowl assembly.

Vertical Pump Having Top Wear-Ring Bearings

By way of further example, and according to some embodiments, the present invention may include, or take the form of, a vertical pump, featuring a stationary bowl assembly, a rotating power transmission shaft, impellers and top wear-ring bearings. The stationary bowl assembly includes bowls, each bowl having a respective bowl top inside surface. The rotating power transmission shaft may be configured to extend through the stationary bowl assembly. The impellers may be arranged on the rotating power transmission shaft to rotate and draw material through the stationary bowl assembly, each impeller having a respective impeller top outside surface. Each top wear-ring bearing may be arranged between the respective impeller top outside surface of each impeller and the respective bowl top inside surface of each bowl, made from a non-galling bearing material, and configured to maintain the alignment of the rotating power transmission shaft in relation to the stationary bowl assembly.

Vertical Pump having Top and Bottom Wear-ring Bearings By way of further example, and according to some embodiments, the present invention may include, or take the form of, a vertical turbine pump featuring a stationary bowl assembly, a rotating power transmission shaft, at least one impeller, and top and bottom wear-ring bearings. The stationary bowl assembly may include at least one bowl with bowl top and bottom inside surfaces. The rotating power transmission shaft may be configured to extend through the stationary bowl assembly. The at least one impeller may be arranged on the rotating power transmission shaft to rotate and draw material through the stationary bowl assembly, and have impeller top and bottom outside surface. The top and bottom wear-ring bearings may be arranged respectively between the impeller top and bottom outside surfaces of each impeller and the bowl top and bottom inside surfaces of each bowl, may be made from a non-galling bearing material, and configured to maintain the alignment of the rotating power transmission shaft in relation to the stationary bowl assembly.

The vertical turbine pump may include one or more of the features disclosed above, e.g., including where the stationary bowl assembly includes multiple bowls and the at least one impeller includes multiple impellers arranged on the rotating power transmission shaft.

Advantages

By transferring all functions of the suction bearing to the bottom wear ring/bearing, all of its associated retainer structure can be removed from the stationary bowl assembly. This removes all obstructions from the inlet into the eye of the bottom impeller. Eliminating the obstruction consequently minimizes the required pressure of the surrounding ambient fluid in open pit applications or in the suction line in closed loop applications. This translates directly into a reduction of the Net Positive Suction Head required (NPSHr). Additionally, with the entrant losses minimized, the overall efficiency of the pump will be increased.

Since the suction bell no longer needs to function as a support for the loads associated with the suction bearing retainer, its only remaining function is to guide flow into the eye of the bottom impeller. This function can be accomplished with lower strength materials such as plastic, reducing both weight and cost of the traditional cast iron construction.

The inclusion of both upper and lower wear rings, and with each of these wear rings being constructed from a non-galling bearing material such as Vesconite®, enables the incorporation of all functions of the bearing into the wear ring. With the impeller now rotating directly against the effective bearing of the pump rather than suspended between two bearing supports in other works in the prior art, the deflection in the power transmission shaft is eliminated, and the corresponding vibration is significantly reduced.

Relocation of the bowl bearing functions to the wear ring and the associated bearing retainer material now exposes the top of the impeller to the low pressure side of the preceding material. Additionally, the presence of the top wear ring now isolates the top of the impeller from the pressure generated by the impeller. This reduces the hydraulic load on the impeller, and consequently reduces the load on the shaft, and the corresponding shaft deflection (stretch).

Inclusion of upper and lower wear rings now eliminates the need to increase running clearances in cases where special corrosion resistant materials susceptible to galling are used. This further decreases field galling issues as well increasing the product hydraulic efficiency as opposed to the observed reduction in hydraulic efficiency associated with the previous method of increasing the running clearances of the galling parts.

The manner in which the product is operated is not altered by the inclusion of the present invention. Instead, the operational efficiency and NPSHr of the pump is improved with the removal of the suction bearing and its associated housing, and with the removal of the now redundant bowl bearings and associated retainers. Inclusion of the non-metallic wear rings eliminates galling in harsher environments, and with the reduction in product vibration, the operational life of the pump is extended.

BRIEF DESCRIPTION OF THE DRAWING

The drawing, which is not necessarily drawn to scale, includes the following Figures.

Similar parts or components in Figures are labeled with similar reference numerals and labels for consistency. Every lead line and associated reference label for every element is not included in every Figure of the drawing to reduce clutter in the drawing as a whole.

DETAILED DESCRIPTION OF THE INVENTION

Figure 1:
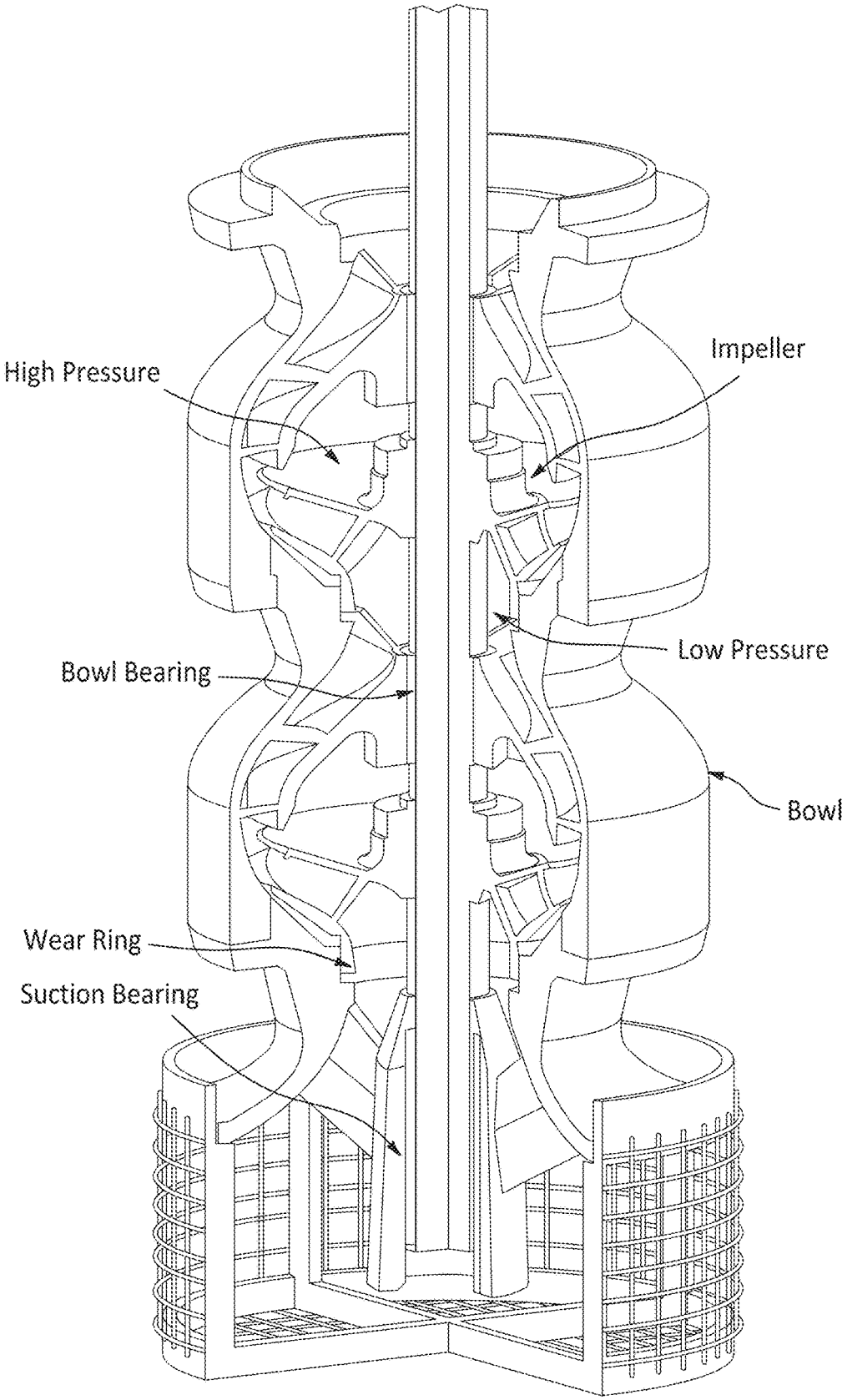
FIG. 1 (PRIOR ART)
FIG. 1 shows a partial cross-sectional view of a vertical turbine pump that is known in the art, e.g., having a bowl bearing above each impeller, a suction bearing below a bottom impeller in a suction bell/bowl of a stationary bowl assembly, and a suction bearing retainer coupling the suction bearing to the suction bell/bowl of the stationary bowl assembly.
Figure 2:
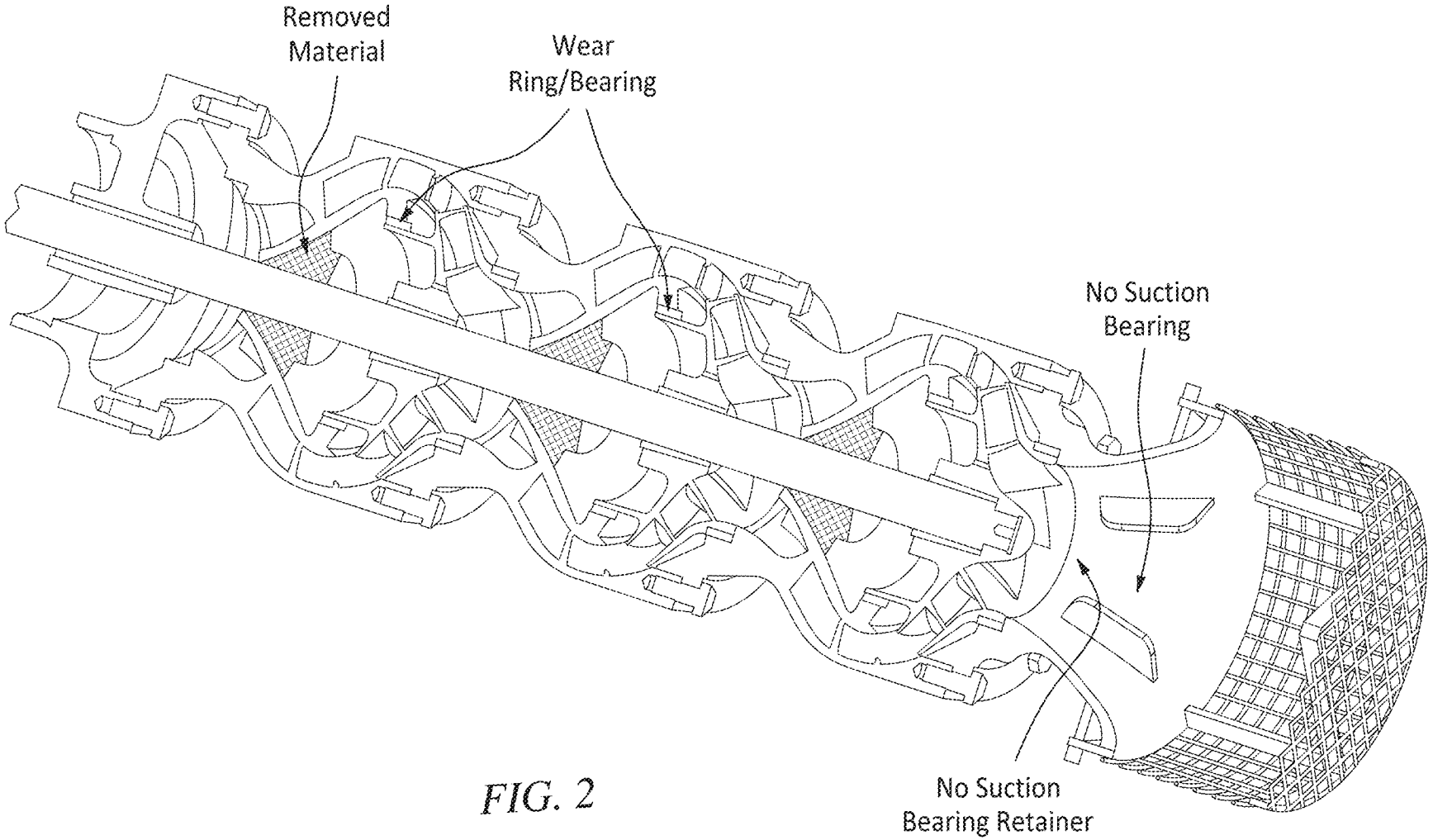
FIG. 2 shows a cross-sectional view of a vertical turbine pump according to some embodiments of the present invention, having indications of removed material (e.g., the bowl bearing above each impeller like that shown in FIG. 1), of no suction bearing below the bottom impeller in the suction bell/bowl, and of no suction bearing retainer, by implementating of the present invention.
Figure 3:
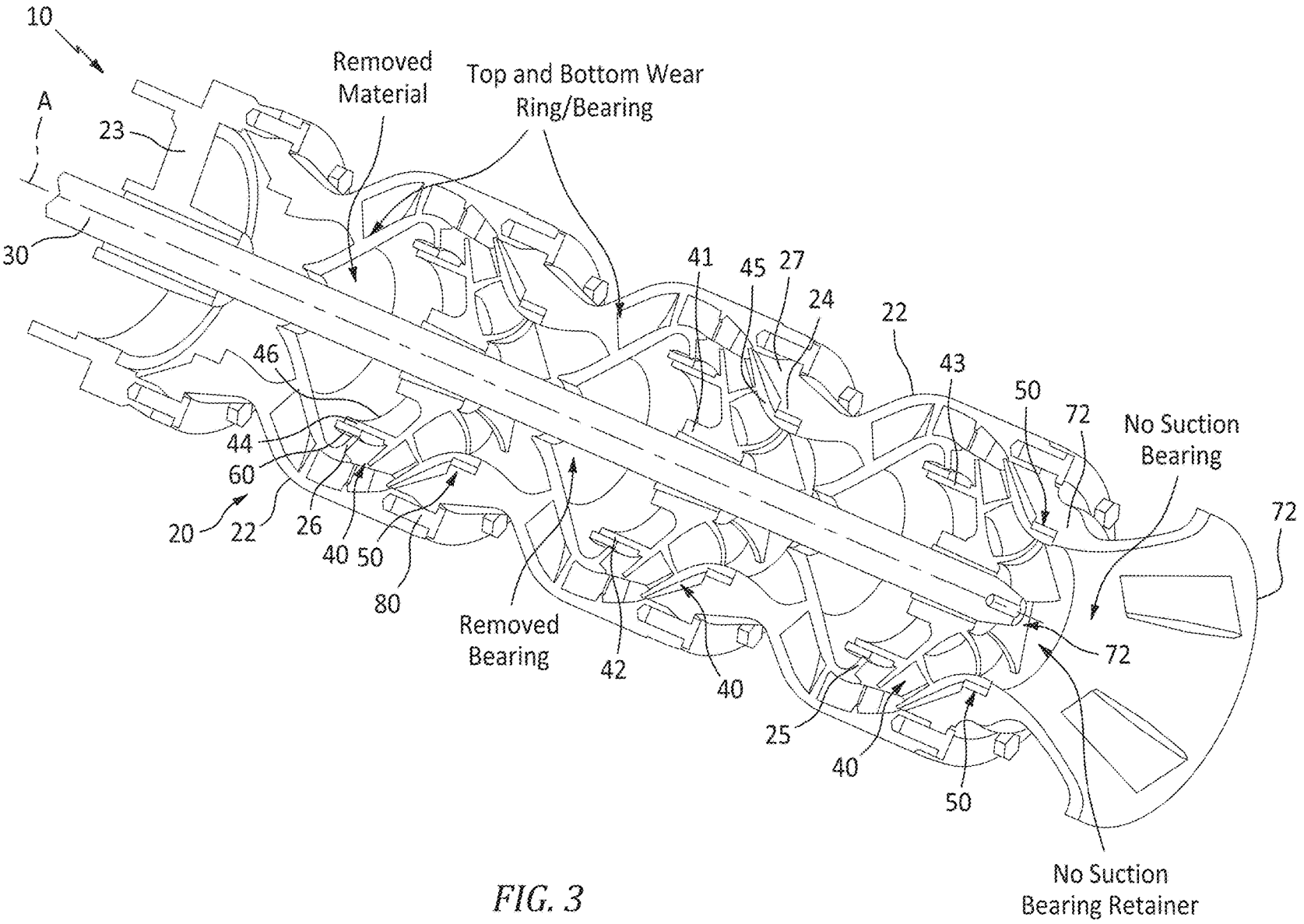
FIG. 3 shows a cross-sectional view of the vertical turbine pump in FIG. 2 without showing the bowl bearing above each impeller that is removed in embodiments according to the present invention.

By way of example, and according to some embodiments, FIGS. 2 and 3 show a vertical pump according to the present invention and generally indicated as 10, featuring a stationary bowl assembly 20, a rotating power transmission shaft 30, impellers 40, bottom wear-ring bearings 50 and top wear-ring bearings 60.

The stationary bowl assembly 20 may include three bowls 22, a top member 23 and a lower suction bell 70, e.g., coupled together using fasteners, one of which is labeled 80. The present invention is not intended to be limited to the number of bowls in the stationary bowl assembly 20, e.g., which may include more than three bowls 22 or fewer than three bowls 22.

Each bowl 22 may include a respective bowl bottom inside surface 24 and a respective bowl top inside surface 26, e.g., designated and corresponding to impeller top and bottom outside surfaces described below. Each bowl 22 may include an inner circumferential rim 25 that protrudes inwardly perpendicular to the rotational axis A of the rotating power transmission shaft 30. The bowl top inside surface 26 is configured to extend circumferentially around the inner circumferential rim 25 inside the bowl 22. The respective bowl bottom inside surface 24 is configured on a corresponding bowl portion 27 of an adjacent lower bowl 22 or a corresponding bell portion 72 of the suction bell 70, e.g., consistent with that shown in FIG. 3.

The rotating power transmission shaft 30 is configured to extend through the stationary bowl assembly 20 along the rotational axis A.

The impellers 40 may include three impellers 40 arranged on the rotating power transmission shaft 30 and configured in relation to the three bowls 22 to rotate and draw material through the stationary bowl assembly 20. Each impeller 40 may include a respective impeller bottom outside surface 42 and/or a respective impeller top outside surface 44, e.g., corresponding to the bowl bottom and top inside surfaces 24, 26 described above. Each impeller 40 has a respective impeller vane 41 configured to draw the material, and includes a respective impeller upper vane portion 43 and a respective impeller lower vane portion 45. The respective impeller top outside surface 44 is configured to extend circumferentially around the respective impeller upper vane portion 43, and the respective impeller bottom outside surface 42 is configured to extend circumferentially around the respective impeller lower vane portion 45, e.g., consistent with that shown in FIG. 3.

Each bottom wear-ring bearing 50 may be arranged between the respective impeller bottom outside surface 42 of each impeller 40 and the respective bowl bottom inside surface 24 of each bowl 22, may be made from a non-galling bearing material, and configured to maintain the alignment of the rotating power transmission shaft 30 in relation to the stationary bowl assembly 20. By way of example, each bottom wear-ring bearing 50 may be arranged, coupled or fastened to the respective bowl bottom inside surface 24 of each bowl 22, e.g., using adhesive, fasteners, etc. The respective impeller bottom outside surface 42 of each impeller 40 may be configured to rotate directly against the respective bottom wear-ring bearing 50.

Similarly, each top wear-ring bearing 60 may be arranged between the respective impeller top outside surface 44 of each impeller 40 and the respective bowl top inside surface 26 of each bowl 22, may be made from a corresponding non-galling bearing material, and configured to maintain the alignment of the rotating power transmission shaft 30 in relation to the stationary bowl assembly 20. By way of example, each top wear-ring bearing 60 may be arranged, coupled or fastened to the respective bowl top inside surface 26 of each bowl 22. The respective impeller top outside surface 44 of each impeller 40 may be configured to rotate directly against the respective top wear-ring bearing 60.

By way of example, the scope of the invention is intended to include, and embodiments are envisioned, using bottom wear-ring bearings 50 alone, top wear-ring bearings 60 alone, and some combination of bottom and top wear-ring bearings 50, 60.

According to some embodiments, the top and bottom wear-ring bearings 50, 60 may be configured to expose a top side 46 of at least one of the impellers 40 to a low pressure side of preceding material being pumped through the stationary bowl assembly 20.

According to some embodiments, the top wear-ring bearings 60 may be configured to isolate the top side 46 of at least one of the impellers 40 from pressure generated by the at least one of the impellers 40.

According to some embodiments, the top and bottom wear-ring bearings 50, 60 may be configured to provide substantially reduced running clearances between the at least one impeller 40 and the at least one bowl 22 of the stationary bowl assembly 20.

The Suction Bell 70

The suction bell 70 may be configured to guide flow of the material being pumped into an eye of a bottom impeller 40. The suction bell 70 may be made of a non-metallic material, including a non cast iron material. The non-metallic material may be plastic.

Vesconite®

By way of example, the non-galling bearing material may include a non-metallic material such as Vesconsite®.

Vesconite® is a specialized hard-wearing thermopolymer/thermoplastic made from internally lubricated polymers and designed for challenging operating conditions that is manufactured by a company having the name, Vesconite Bearings (see vesconite@vesconite.com), and that may provide up to 10 times the life of traditional bronze or nylon bushings. By combining its high load-bearing strength, internal lubrication, low friction coefficient and low wear rate, Vesconite® does not require external lubrication, even in harsh, dry and dirty working environments.

Fastening of the Wear-Ring Bearings 50, 60

By way of further example, the scope of the invention is intended to include coupling or fastening the bottom wear-ring bearing 50 to the respective impeller bottom outside surface 42 of each impeller 40.

By way of further example, the scope of the invention is intended to include coupling or fastening the top wear-ring bearing 50 to the respective impeller top outside surface 44 of each impeller 40.

Possible Applications

The present invention can be used in all applications supported by the unmodified vertical turbine pump, but is particular advantage in cases where corrosion materials, higher product efficiency and low NPSHr is required. Some typical examples include, but are not limited to the following:

Cooling towers
Fire suppression
Power Plants
Process water
Municipal water transport

THE SCOPE OF THE INVENTION

The embodiments shown and described in detail herein are provided by way of example only; and the scope of the invention is not intended to be limited to the particular configurations, dimensionalities, and/or design details of these parts or elements included herein. In other words, one skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein and thereto without departing from the spirit and scope of the present invention.

What we claim is:

1. A vertical pump having a top end with a top member and a bottom end with a suction bell, comprising:

a stationary bowl assembly having bowls arranged between the top member and the suction bell, each bowl having a respective top inside surface and also having a respective bottom inside surface, each bowl also having a respective bowl bearing portion with a respective top opening and a respective bottom opening, but with no respective bowl bearing arranged therein;

a rotating power transmission shaft configured to extend through the stationary bowl assembly and pass through the respective top opening and the respective bottom opening of the respective bowl bearing portion of each bowl;

impellers arranged on the rotating power transmission shaft to rotate and draw material through the bowls of the stationary bowl assembly, each impeller having a respective impeller top portion with a respective impeller top outside surface and also having a respective impeller bottom portion with a respective impeller bottom outside surface; and top and bottom wear-ring bearings, each top wear-ring bearing arranged between the respective impeller top outside surface of each impeller and the respective bowl top inside surface of each bowl and configured to isolate the respective impeller top portion from pressure generated by each impeller, each bottom wear-ring bearing arranged between the respective impeller bottom outside surface of each impeller and the respective bottom inside surface of each bowl, the top and bottom wear-ring bearings being made from a non-galling bearing material, and configured to maintain the alignment of the rotating power transmission shaft in relation to the stationary bowl assembly, and bearings also combining to eliminate any need for any bottom suction bearing in the suction bell and any respective bowl bearings in the bowl bearing portions of each bowl between the top member and the suction bell.

2. The vertical pump according to claim 1, wherein the non-galling bearing material is a non-metallic material, including a thermopolymer or thermoplastic.

3. The vertical pump according to claim 1, wherein the respective impeller outside surface of each impeller is configured to rotate directly against a respective wear-ring bearing.

4. The vertical pump according to claim 1, wherein each top wear-ring bearing is configured to expose a top side of a respective impeller to a low pressure side of preceding material being pumped through the stationary bowl assembly.

5. The vertical pump according to claim 1, wherein the top and bottom wear-ring bearings are configured to provide reduced running clearances between the impellers and the bowls of the stationary bowl assembly.

6. The vertical pump according to claim 1, wherein the vertical pump comprises a suction bell configured to guide flow of the material being pumped into an eye of a bottom impeller.

7. The vertical pump according to claim 6, wherein the suction bell is made of a non-metallic material, including a non cast iron material.

8. The vertical pump according to claim 7, wherein the non-metallic material is plastic.

9. The vertical pump according to claim 1, wherein the top and bottom wear-ring bearings of each impeller provide for a driving imbalance that is equidistant between each impeller.

10. The vertical pump according to claim 1, wherein the top member comprises a top bearing portion having a bowl bearing arranged therein configured to receive the rotating power transmission shaft.

* * * * *